United States Patent [19]

Urso

[11] Patent Number: 5,069,205

[45] Date of Patent: Dec. 3, 1991

[54] QUICK-DONNING HEAD HARNESS ASSEMBLY

[75] Inventor: Tina Urso, Amherst, N.Y.

[73] Assignee: Figgie International, Inc., Willoughby, Ohio

[21] Appl. No.: 512,784

[22] Filed: Apr. 20, 1990

[51] Int. Cl.[5] ..... A62B 7/00

[52] U.S. Cl. ..... 128/201.24; 128/206.12; 128/206.17; 128/206.21; 128/206.24; 128/206.28.207.11

[58] Field of Search ..... 2/183, 197, 417, 421; 128/207.11, 201.22, 201.23, 201.24, 201.29, 206.12, 206.17, 206.21, 206.24, 206.28

[56] References Cited

U.S. PATENT DOCUMENTS

| | | | |
|---|---|---|---|
| 1,177,383 | 3/1916 | Claren | 128/201.23 X |
| 1,706,602 | 3/1929 | Dräger | 128/201.22 |
| 2,344,718 | 4/1940 | Morehouse | 128/201.23 |
| 3,457,564 | 7/1969 | Holloway . | |
| 3,833,935 | 9/1974 | Ansite et al. . | |
| 4,069,516 | 1/1978 | Watkins, Jr. . | |
| 4,614,189 | 9/1986 | MacKenzie . | |
| 4,817,596 | 4/1989 | Gallet . | |
| 4,910,806 | 3/1990 | Baker et al. | 2/452 |
| 4,915,064 | 4/1990 | Aulgur et al. | 128/207.11 |
| 4,960,121 | 10/1990 | Nelson et al. | 128/206.24 |
| 4,971,051 | 11/1990 | Toffolon | 128/206.26 |

*Primary Examiner*—Edgar S. Burr
*Assistant Examiner*—E. P. Raciti
*Attorney, Agent, or Firm*—Hodgson Russ Andrews Woods & Goodyear

[57] ABSTRACT

A quick-donning head harness assembly (10) used in combination with a respirator face mask assembly (12) of the type including a rigid facepiece (14) and a flexible face seal (16), which head harness assembly and face mask assembly may be quickly donned and adjusted without becoming entangled with the wearer's hair. The head harness assembly includes a cap (24) provided with a lower strap casing (24.2) and an upper strap casing (33). A lower elasticized strap passes through the lower casing, the forward ends of the strap passing through adjusting buckles (46) supported by lower corners of the facepiece. Rings (38) are connected to the upper corners of the facepiece (14) and an upper adjustable strap (48) has right and left temple portions (48.2) passing through the ring, the strap being folded back upon itself, the end portions (48.3) of the strap being provided with a "velcro" pile which may cooperate with a "velcro" pile on the upper strap casing (33) for adjustably positioning the upper corners of the facepiece. In addition, a rigid support (26) extends between the upper corners of the facepiece and the top forward corners of the cap (24).

6 Claims, 2 Drawing Sheets

Fig. 3.
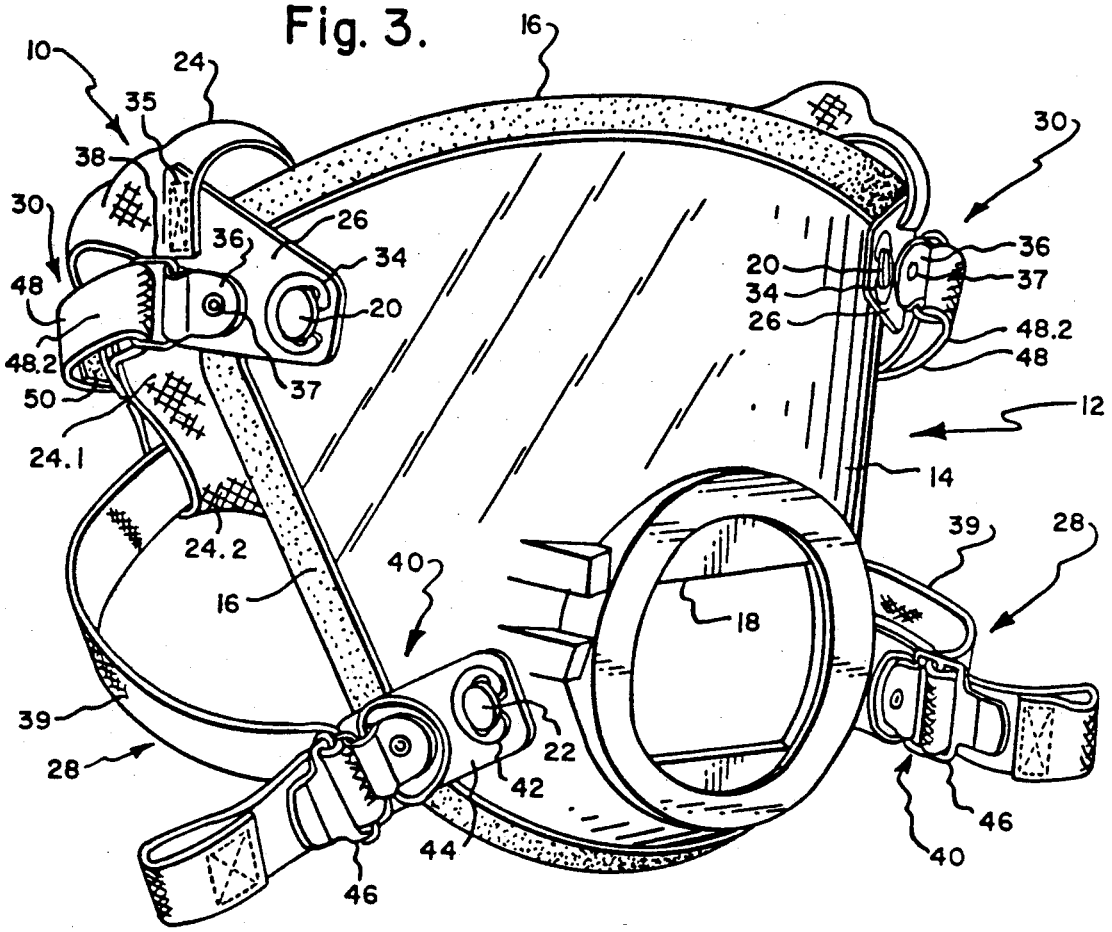
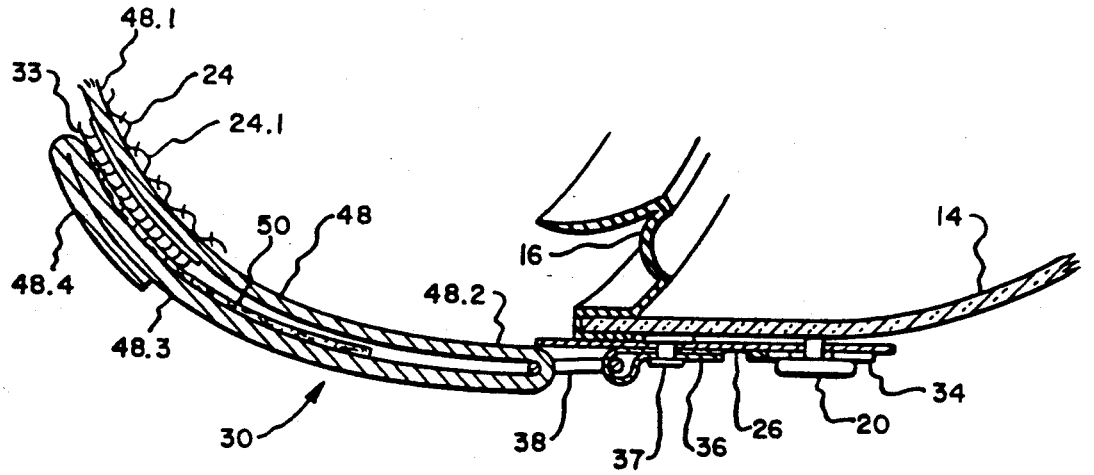
Fig. 4.

QUICK-DONNING HEAD HARNESS ASSEMBLY

FIELD OF THE INVENTION

The present invention relates generally to a quick-donning head harness assembly of the type from which a respirator face mask may be suspended, and more particularly to a quick-donning head harness assembly including a cap made of a low friction material which slides over the head without snagging or pulling the hair, and upper or lower adjustable elasticized straps, side portions of which extend between the mask and the cap. The cap covers most of the wearer's hair, and the rear portions of the adjustable straps are kept from interfering with the hair during adjustment by the low friction material, which is disposed between the rear portions of the straps and the hair. The straps when properly adjusted ensure a good fit of the face mask.

BACKGROUND OF THE INVENTION

Quick-donning head harness assemblies are well known in the art and one example is EZ-Don FHR facepiece harness available from the Mine Safety Appliance Co. in Pittsburgh, Penn. Another well known example is the head harness for the Scott-O-Vista facepiece available from the Scott Aviation Division of Figgie International. In addition to these commercially available head harness assemblies, others are known from the patent literature. U.S. Pat. Nos. 3,457,564; 4,595,003; 4,029,092; 4,414,973; and 1,177,383 are typical examples. The various designs are for the purpose of maintaining a face mask on the wearer's face. A typical face mask construction includes a rigid facepiece and a flexible face seal supported by the facepiece. A rigid facepiece may include either a rigid lens or a rigid shell. As the sizes of the wearer's faces vary from small to large, and as the individual contour of each face is somewhat different, for example some have prominent cheekbones, it is necessary in order to secure a good seal to maintain suitable pressure over the entire periphery of the face seal adjacent to the wearer's face. In addition, it is also desirable that the head harness assembly can be placed over the wearer's head without becoming entangled with the wearer's hair. It is also desirable that the face mask can be worn without undue discomfort. While various designs have been utilized in the past, some of which involve facepieces of differing sizes, there is always a chance of some penetration of gases past the face seal to the wearer's face. One problem exists where wearers fail to properly don equipment or to properly adjust the equipment once donned. It is believed that one of the reasons wearers fail to either properly don or properly adjust existing head harness assemblies is the fear that the harness may become entangled in the hair during donning or adjustment. Another disadvantage of existing designs is that there may be only two points of adjustment, usually in the jaw or neck area.

OBJECTS AND SUMMARY OF THE INVENTION

It is an object of the present invention to provide a quick-donning head harness assembly for use with a face mask assembly of the type having a rigid facepiece and a flexible face seal wherein the head harness assembly may be quickly donned without snagging the wearer's hair and which may be adjusted to provide a good fit of the face seal to the wearer's face to prevent or reduce penetration of gases past the face seal.

More specifically, it is an object of the present invention to provide a quick-donning head harness assembly of the character set forth above wherein the head harness includes a cap which may be slid over the wearer's head without becoming entangled in the hair, the cap being made of a low friction material.

It is a further object of the present invention to provide a quick-donning head harness assembly of the character set forth above wherein the harness assembly includes upper and lower adjustable straps so designed that the pressure of the face seal of the associated face mask can be properly adjusted to minimize penetration of gases between the face seal and the wearer's face.

The foregoing objects as well as other objects are achieved by providing a quick-donning head harness assembly which includes a cap formed of low friction material, a pair of constant length means securing upper side portions of the lens or shell of the face mask to the upper side portions of the cap, lower adjustable length means securing lower side portions of the facepiece to lower side portions of the cap, and a pair of adjustable length means for securing upper side portions of the lens or shell to the cap in the area of the temples, the low friction material of the cap lying between the upper and lower adjustable length means.

The foregoing objects and other objects and advantages of this invention as well as the details of the present invention will become more apparent after a consideration of the following description taken in conjunction with the accompanying drawings in which a preferred form o this invention is illustrated.

BRIEF DESCRIPTION OF THE DRAWINGS

FIG. 3 is a front side perspective view of the structure shown in FIG. 1.

FIG. 4 is a section taken generally along line 4—4 in FIG. 1.

DETAILED DESCRIPTION

The quick-donning head harness assembly of this invention is indicated generally at 10, the assembly being shown associated with a face mask assembly indicated generally at 12. The face mask assembly includes a rigid facepiece, and a flexible face seal. In the illustrated embodiment the face mask includes a rigid lens 14, a peripheral flexible face seal 16 being supported thereon. The lens 14 is provided with a suitable aperture 18 which may receive air supply or purifying equipment. While the illustrated face mask includes a full-length lens 14 which is provided with an aperture 18 for the receipt of air supply or purifying equipment, it should be appreciated that other forms of face mask assemblies may be utilized. In one alternate form a shorter length lens may be utilized, the lens in this situation being integrated into a face seal 16 of greater length and area. In another alternative design the rigid facepiece may be a shell. In the design shown in the accompanying drawings, the lens 14 is provided with upper and lower mounting studs 20, 22. However, the mounting for the head harness may be integrated into the seal assembly rather than into the lens.

Figure 1:
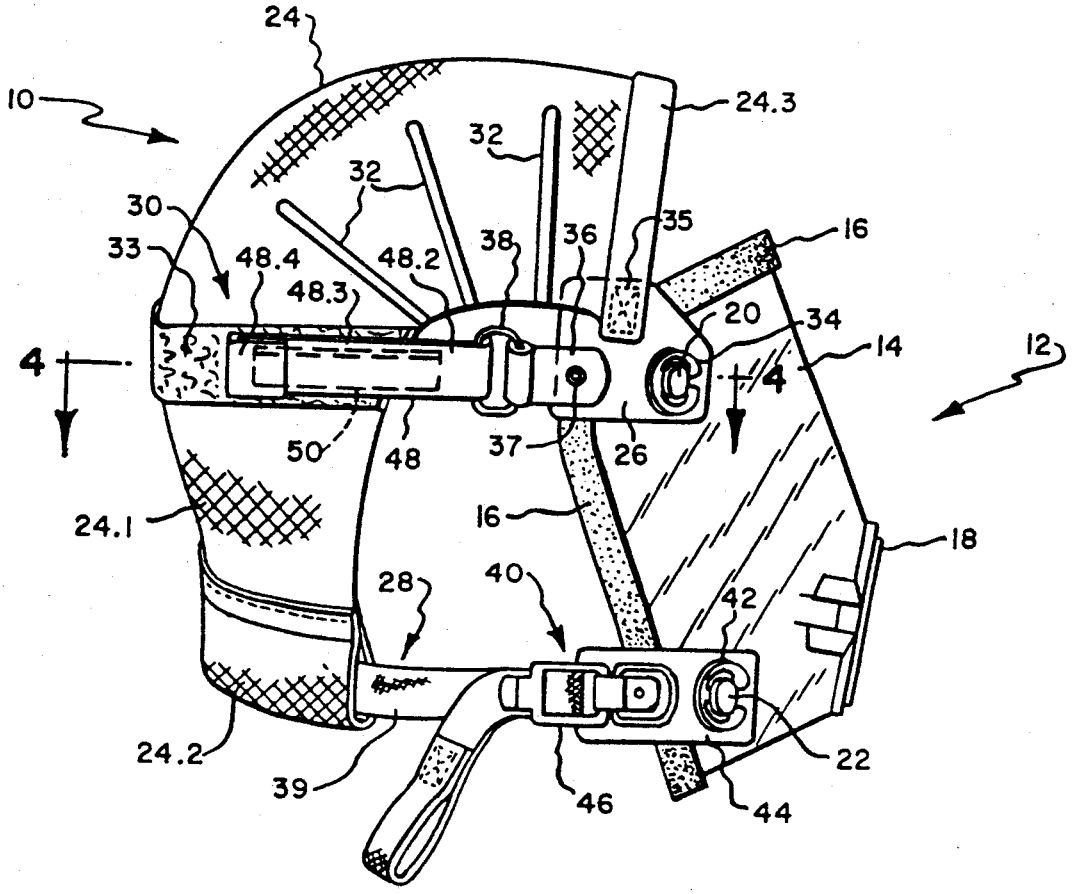
FIG. 1 is a right side elevational view of the quick-donning head harness assembly of this invention in combination with a face mask assembly.
Figure 2:
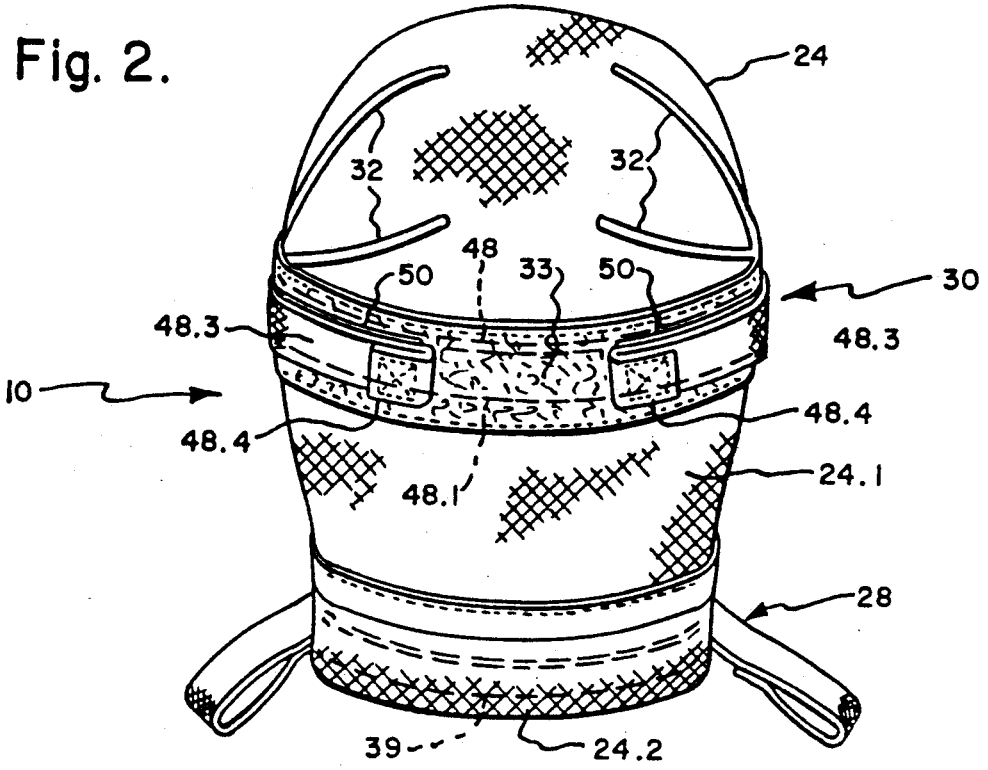
FIG. 2 is a rear elevational view of the structure shown in FIG. 1.

As can be seen from the FIGS., the quick-donning head harness assembly of this invention is essentially symmetrical. Thus, while only the right-hand side of the head harness assembly is shown in FIG. 1, it should be appreciated that the left-hand side is substantially identical. The head harness includes, as its major components, a cap 24, right and left constant length securing means 26, lower adjustable length means indicated generally at 28, and upper adjustable length means indicated generally at 30.

As previously indicated, the cap is made from a low friction material which is preferably a lightweight open mesh net of polypropylene or polyester (for nonfire-fighting applications) or Kevlar (for fire-fighting applications). As can be seen, this material is suitable sewn, the darts 32 being for the purpose of shaping the cap about the crown of the wearer's head. In addition, the back 24.1 of the cap is suitably contoured to fit the back of the wearer's head. The lower rear portion of the cap 24 is folded back upon itself and sewn to form a lower strap casing 24.2. In addition, the front upper edge is suitably hemmed as at 24.3. A strip of hook or loop pile fabric 33, such as that sold under the trade name "Velcro" has its upper and lower edges sewn to the back of the cap to form a casing for the central portion of the upper adjustable length means 30, the pile of the "Velcro" material extending away from the cap.

The right- and left-hand constant length securing means 26 may be formed of any suitable material and in a preferred embodiment they are formed of neotext-coated polyester or nomex webbing. As can be seen, each of the constant length securing means is of a somewhat trapezoidal shape, the forward end portion being suitably apertured for receiving the stud 20, the constant length securing means 26 being held onto the stud 20 by a C-washer 34 which is suitably received by the stud 20. The upper rear end portion of the constant length securing means is suitably sewn by thread 35 to the hem 24.3. A clip 36 is secured to the lower rear end portion of the constant length securing means by a rivet 37 or the like, the clip carrying a ring 38.

The lower adjustable length means 28 include a fabric neck strap 39 which may be elasticized, which strap has an intermediate or rear portion passing through the strap casing 24.2 in the lower rear portion of the cap 24. Right and left lower adjustable buckle assemblies are provided, each of the adjustable buckle assemblies, which are indicated generally at 40, being secured to a lower stud 22 by means of a suitable C-washer 42. Thus, each buckle assembly 40 includes a strap portion 44 having a forward end portion which is suitably apertured for receipt of the stud 22, a rear end of each strap portion 44 carrying an adjustable buckle 46 of conventional design, an end of the neck strap 39 passing through each of the buckles 46 of conventional design. It should be appreciated that by engaging the right and left ends of the neck strap 39 and by pulling them in an outward or rear direction that the neck strap can be suitably tightened about the neck of the wearer. Similarly, by releasing the adjustable buckles 46, it is also possible to loosen the neck strap for ease of removal.

The upper adjustable length securing means 30 consists of a single elasticized fabric strap 48. As previously indicated, a central back portion 48.1 of the strap 48 is disposed within the "Velcro" casing 33. Intermediate side or temple portions 48.2 of the strap 48 are passed through the rings 38 and are folded back as can best be seen from FIG. 4. Loop or hook pile fabric 50 is sewn to the inner sides of the end portions 48.3 of the strap in cooperating relationship with the hook or loop pile fabric 33. The end portion of each of the upper adjustable length straps 48 is folded back upon itself as at 48.4 to provide a good grip for the wearer.

It can be appreciated from the above description and from a review of the drawings that the adjustable length means 28 and 30 will not snag the hair of the wearer when being secured or released. One reason for this is that the straps 39 and 48 in the area of the cap are separated from the wearer's hair by the cap itself. Another reason is that the straps 39 and 48 are made of an elasticized fabric which is also a low friction material. It has been found that the quick-donning head harness assembly of this invention may be quickly donned by a user and suitably adjusted to a comfortable fit where penetration of gases between the face seal and the wearer's face is minimized. By using the design described above, and particularly through the use of the upper strap 48, the central back portion 48.1 will be stretched when the end portions 48.3 are secured by the "Velcro" casing 33, thus the flexible face seal 16 is snugly held against the wearer's face in the temple region.

While a preferred embodiment in which the present invention has been incorporated is shown in the attached drawings and described above, it should be appreciated that the present invention is not to be limited to the particular details shown and described above, but that, in fact, widely differing means may be employed in the practices of the present invention.

What is claimed is:

1. The quick-donning head harness assembly used in combination with a face mask assembly intended for eye and respiratory protection, the face mask assembly having upper and lower side portions to which the head harness assembly is secured, the head harness assembly being capable of quickly suspending the face mask assembly in front and aligning it with the wearer's face, leaving hands free for quickly adjusting upper and lower seal tightness to provide a continuous seal between the perimeters of the face mask assembly and face whereby penetration of contaminants past the seal is minimized; and said head harness assembly comprising:

a cap having a front portion, a top portion, a lower back portion and an intermediate portion, said cap being suitably contoured to fit portions of the back, top and sides of the wearer's head;

nonadjustable constant length securing means for securing the upper side portions of the face mask assembly to the front portion of the cap for suspending the face mask assembly and enabling quick alignment of the face mask assembly in front of the wearer's face;

lower manually adjustable length securing means for securing the lower back portion of the cap to the lower side portions of the face mask assembly for pulling the lower side portions of the face mask assembly inward and towards the face into sealing contact with at least the lower portion of the face; and upper manually adjustable length securing means for securing the intermediate portion of the cap to the upper side portions of the face mask assembly for pulling the upper side portions of the face mask assembly inward and towards the face into sealing contact with at least the upper portion of the face including the temples, the intermediate portion of the cap being located between the front portion and the lower back portion of the cap.

2. The quick-donning head harness assembly as set forth in claim 1 wherein the upper manually adjustable length securing means comprises a single strap which passes behind the back of the head and is attached near either end to upper side portions of the face mask assembly.

3. The quick-donning head harness assembly as set forth in claim 2 wherein the back of the cap is provided with hook (or loop) pile fastening means and the end portions of the strap are also provided with loop (or hook) pile fastening means for securing the strap portions to the back of the cap while providing an uncountable number of position adjustments and a low profile.

4. The quick-donning head harness assembly as set forth in claim 2 wherein said top and lower back portions of said cap are adapted to substantially cover the entire scalp of the wearer, and wherein the upper and lower manually adjustable length means are separated from contact with the wearer's scalp by the cap, said cap being made of a material with sufficiently low coefficient of friction so that the head harness assembly may be quickly suspended, aligned and adjusted without snagging the wearer's hair.

5. The quick-donning head harness assembly as set forth in claim 1 wherein the lower manually adjustable length securing means comprises a single strap which passes behind the back of the head, said strap having a pair of opposed end portions which are adjustably secured to opposing sides of the face mask assembly.

6. The quick-donning head harness assembly as set forth in claim 1 wherein the upper manually adjustable length securing means comprises a single strap which passes behind the back of the head, the strap having a pair of opposed end portions, which end portions are adjustably secured to a back portion of the cap.

* * * * *